US005170921A

United States Patent [19]

Baldyga

[11] Patent Number: 5,170,921

[45] Date of Patent: Dec. 15, 1992

[54] ADJUSTABLE FEEDER HAVING TWO-PART CAMMING FINGER

[75] Inventor: Joseph Baldyga, Naples, Fla.

[73] Assignee: Diamond Die & Mold Company, Mt. Clemens, Mich.

[21] Appl. No.: 550,475

[22] Filed: Jul. 10, 1990

[51] Int. Cl.[5] ..... B65H 20/00

[52] U.S. Cl. ..... 226/52; 226/55; 226/57; 226/75; 226/170

[58] Field of Search ..... 226/52, 55, 56, 57, 226/58, 74, 75, 120, 170; 403/108, 378, 379

[56] References Cited

U.S. PATENT DOCUMENTS 1,346,299 7/1917 Cooper ..... 403/379 X
1,860,253 5/1932 Lanspa ..... 403/379
3,573,876 4/1971 Powell et al. ..... 403/378 X
3,578,230 5/1971 Baldyga ..... 226/162
3,976,235 8/1976 Baldyga et al. ..... 226/75 X
3,977,587 8/1976 Baldyga et al. ..... 226/74
4,856,927 8/1989 Cusati ..... 403/379 X

*Primary Examiner*—Daniel P. Stodola
*Assistant Examiner*—P. Bowen
*Attorney, Agent, or Firm*—Basile and Hanlon

[57] ABSTRACT

A two piece feed member providing a less costly replacement and the ability to adjust the feed member's length. The two piece configuration only requires that the wearing portion be replaced, and not the entire feed member. This allows for a significant cost savings. Different feed mechanisms require different length feed members, and therefore, an adjustable length feed member allows for the use of one universal feed member.

6 Claims, 1 Drawing Sheet

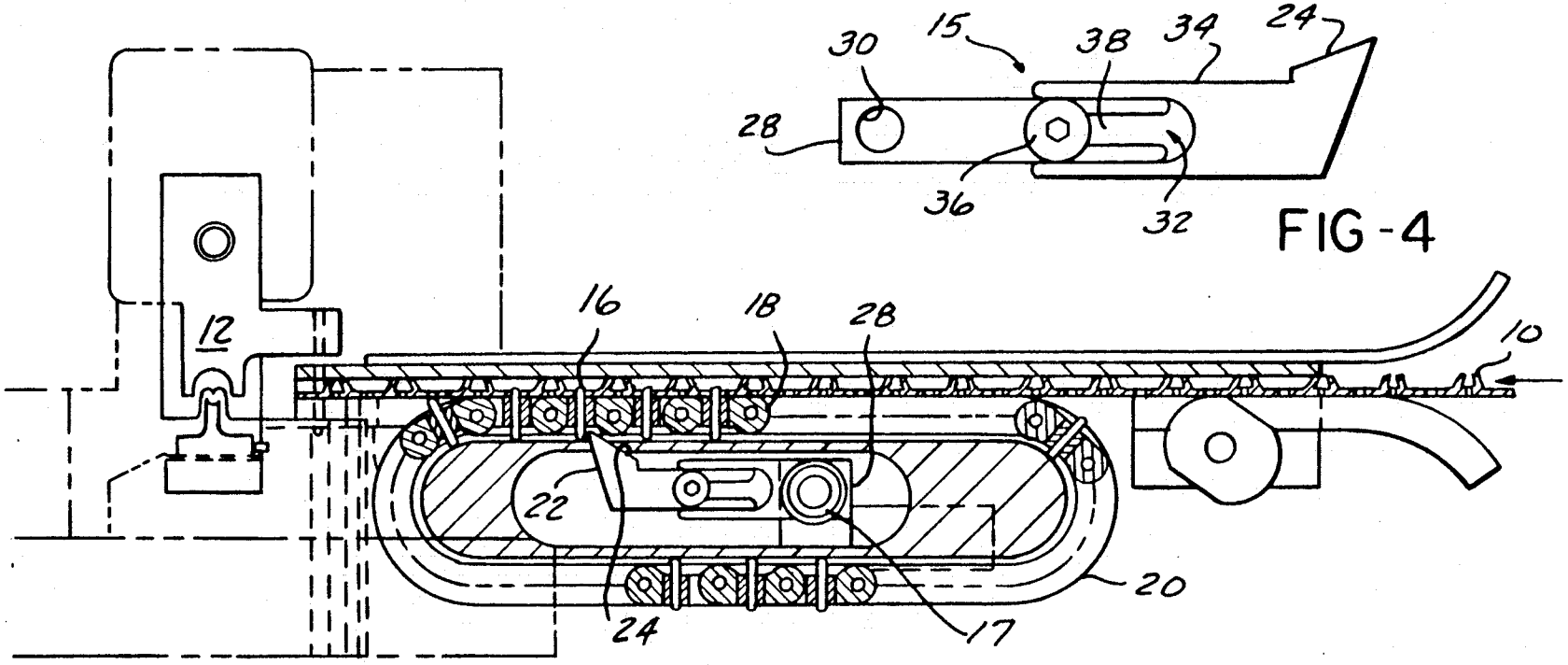
FIG-1
FIG-4
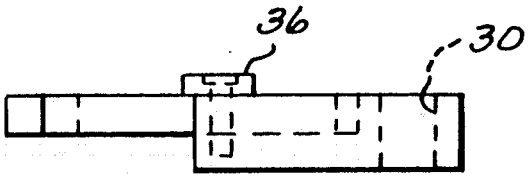
FIG-3
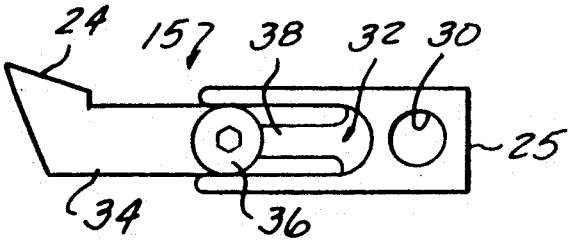
FIG-2

ADJUSTABLE FEEDER HAVING TWO-PART CAMMING FINGER

BACKGROUND OF THE INVENTION

1. Field of the Invention

The present invention generally relates to a multi-piece adjustable feed member and, in particular, to an adjustable feed member which allows for the use of one common feed member amongst a variety of feed mechanism which require different length feed members.

2. Description of the Relevant Art

U.S. Pat. No. 3,977,587 to Baldyga et al., discloses a single piece, non-adjustable feed guide utilized in a conveyor feed mechanism.

U.S. Pat. No. 3,976,235 to Baldyga et al., discloses a single piece, non-adjustable feed guide utilized in a stop feed mechanism.

U.S. Pat. No. 3,578,230 to Baldyga discloses a single piece, adjustable feed guide utilized in a feed mechanism.

SUMMARY OF THE INVENTION

Conveyor feed mechanisms typically utilize a feed member which incrementally advances a conveyor carrying material. Some feed members make direct contact with the material while others make contact with a portion of the conveyor. Where the feed member makes direct contact with the conveyor, wear occurs on the feed member, and periodic replacement is necessary. Replacement requires the same length feed member and, different feed mechanisms require different size feed members, all of which requires that the user of different mechanism maintain a large supply of feed members on hand.

Since replacement occurs on a regular basis, it would be a cost advantage to replace only the portion of the feed member which exhibits wear. Therefore, a two piece feed member allows for the wearing end of the feed member to be replaced while allowing the non-wearing end to remain as a base attachable to the feed mechanism. The two piece configuration of the present invention allows the feed member to be utilized on a large variety of related conveyor feed mechanisms, thus minimizing the number of feed members to be kept in inventory.

It is therefore, an object of the present invention to develop a multi-piece adjustable feed member in which only the wearable portion of the feed member need be replaced.

It is another object of the invention to create a feed member which is adjustable in length so that a universal member can be utilized in most feed member applications.

BRIEF DESCRIPTION OF THE DRAWINGS

Other objects, features,and advantages of the present invention will become more fully apparent from the following detailed description of the preferred embodiment, the appended claims, and in the accompanying drawings in which:

FIG. 1 is a cross-section of a typical conveyor feed mechanism in which the invention is utilized;

FIG. 2 is a front elevational view of a feed member constructed in accordance with the principles of the present invention; and FIG. 3 is a bottom view thereof.

FIG. 4 is a front elevational view of a second embodiment of the feed member.

DESCRIPTION OF THE PREFERRED EMBODIMENT

FIG. 1 shows a typical environment in which the invention is utilized. The drawing shows a conveyor feed mechanism which feeds a strip of material 10 into a die or punch 12. The invention is a feed member 15 which indexes the conveyor 20 by pushing an abutment 16 on the feed stroke and idly camming over the abutment 16 on the return stroke. The abutments 16 are created by pins 16 which extend from the center of the chain links 18. On the Outside of the conveyor belt 20, the pins 16 insert into matching holes in the incoming strip of material 10. On the inside of the conveyor belt 20, the feed member 15 pushes the protruding pin 16 on the feed stroke with the end of the feed member 22. On the feed member's return stroke, the protruding pin 16 idly cams over the feed member's cam surface 24. This metal to metal dynamic contact creates wear on the feed member 15 and requires that the feed member 15 be replaced periodically.

FIGS. 2 and 3 illustrates the invention as a two piece feed member 15 in greater detail. One piece of the feed member 15 comprises a base 26 which is secured to the feed mechanism 28 by a bolt 17 (FIG. 1) inserted through a hole 30 in the base 26. The base 26 provides a pocket 32 which is formed by an open ended "U" shaped slot cut partially through the base 26. The second piece of the feed member 15 comprises a finger 34 which is secured to the base 26 by a screw 36. The finger 34 contains an open ended "U" shaped slot 38 that is cut through the finger 34. The slotted end of the finger 34 inserts into the pocket 32 of the base 26, therefore allowing the length of the feed member 15 to be adjustable. The finger 34 slides along the pocket 32 until the desired length of the feed member 15 is determined. Once the desired length of the feed member 15 is determined, the screw 36 is tightened to secure the desired length.

The two piece feed member 15 allows for the replacement of only a worn out finger 34 and not the entire feed member 15 as has been the situations with prior art designs. This is a substantial cost savings since the feed member 15 requires the use of relatively high priced materials. The two piece configuration also allows the length of the feed member 15 to be adjusted so that a universal feed member may be used in a variety of feed mechanisms that require different length feed members.

While one embodiment of the invention has been disclosed in connection with the preferred embodiment thereof, it should be understood that there may be other embodiments which fall within the spirit and scope of the invention and that the invention is susceptible to modification, variation, or change without departing from the proper scope and fair meaning of the following claims:

What is claimed:

1. In a feed apparatus for feeding terminal stock to an applicator having a chain linked conveyor with projections on one side creating abutments for a feed member to push during a feed stroke and idly cam over on a return stroke, the improvement to said feed member comprising:

a multiple element feed member having a base carried by said feed apparatus;

a finger having a projecting cam surface for idly camming said finger over said projections on said return stroke while said finger projects to engage and push said projections on said feed stroke; and means for removably attaching said finger to said base for adjustably varying a length of said feed member.

2. The feed apparatus defined in claim 1, further comprising:

said base having an open ended slot formed in said base; and said finger having an open ended slot cut through said finger, wherein said finger is inserted into said slot formed in said base.

3. The feed apparatus defined in claim 1, further comprising:

said base having an open ended slot cut through said base; and said finger having an open ended slot formed in said finger, wherein said base is inserted into said slot formed in said finger.

4. A multiple element feed member for feeding terminal stock to a wire applicator apparatus having a conveyor with projections on one side creating abutments for said feed member to push during a feed stroke and idly cam over on a return stroke, said multiple element feed member comprising:

a base with an open ended slot formed partially through said base, said base carried by said wire applicator apparatus;

a finger containing an open ended slot cut through said finger adjacent a first end, said first end engageable within said slot formed partially through said base, a portion of said finger having a first surface disposed adjacent a second end for pushing said projections on said conveyor for feeding said terminal stock during said feed stroke and further having a second surface adjacent said first surface for idly camming over said projection on said return stroke; and means for connecting said base to said finger wherein a length of said feed member may be varied.

5. In a feed apparatus for feeding terminal stock formed of a generally continuous strip of material to a wire applicator, said feed apparatus including a conveyor having projections on one side creating abutments for a feed member to push during a feed stroke and to idly cam over on a return stroke, the improvement to said feed member comprising:

an elongated base member carried by said feed apparatus, said elongated base member having an elongated slot formed therein opening axially at one end and opening transversely along one side surface thereof over an entire longitudinal length of said elongated slot;

an adjustable and replaceable elongated finger member, said finger member having a projection-contacting push surface adjacent a first end and a projection-contacting cam surface adjacent said push surface, a second end of said finger member removably engageable within said slot formed in said base member; and means for removably and adjustably attaching said finger member to said base member while allowing variable adjustment of a length of said feed member.

6. The improvement of claim 5 wherein the means for removably and adjustably attaching further comprises:

said finger member having a longitudinally extending slot in said second end: and a compression bolt passing through said longitudinally extending slot in said finger member and engagable with said base member for securely holding the finger member in a desired position when tightened.

* * * * *